US008113864B2

(12) United States Patent
Chiang

(10) Patent No.: US 8,113,864 B2
(45) Date of Patent: Feb. 14, 2012

(54) QUICK-DETACHABLE TERMINAL SEAT AND PROGRAMMABLE LOGIC CONTROLLER HAVING THE SAME

(75) Inventor: Tzu-Tsung Chiang, Taoyuan Shien (TW)

(73) Assignee: Delta Electronics, Inc., Taoyuan (TW)

( * ) Notice: Subject to any disclaimer, the term of this patent is extended or adjusted under 35 U.S.C. 154(b) by 138 days.

(21) Appl. No.: 12/779,531

(22) Filed: May 13, 2010

(65) Prior Publication Data

US 2011/0281453 A1 Nov. 17, 2011

(51) Int. Cl.
*H01R 13/625* (2006.01)

(52) U.S. Cl. ..... 439/347; 439/709

(58) Field of Classification Search ..... 439/347, 439/709, 637
See application file for complete search history.

(56) References Cited

U.S. PATENT DOCUMENTS

| | | | | | |
|---|---|---|---|---|---|
| 3,270,313 | A | * | 8/1966 | Sautois | 439/329 |
| 3,425,025 | A | * | 1/1969 | Williams | 439/347 |
| 3,766,550 | A | * | 10/1973 | Vandemore et al. | 345/206 |
| 3,930,706 | A | * | 1/1976 | Obuch et al. | 439/249 |
| 3,953,797 | A | * | 4/1976 | Bally Berard et al. | 324/537 |
| 3,992,654 | A | * | 11/1976 | Springer et al. | 439/31 |
| 4,001,797 | A | * | 1/1977 | Buss et al. | 340/870.09 |
| 4,082,407 | A | * | 4/1978 | Smorzaniuk et al. | 439/487 |
| 4,174,147 | A | * | 11/1979 | Waddington et al. | 439/636 |
| 4,385,791 | A | * | 5/1983 | Lovrenich | 439/83 |
| 4,460,235 | A | * | 7/1984 | Gelin | 439/629 |
| 4,466,686 | A | * | 8/1984 | Houser | 439/568 |
| 4,473,263 | A | * | 9/1984 | Sunstein | 439/64 |
| 4,482,938 | A | * | 11/1984 | Norden | 361/823 |
| 4,527,849 | A | * | 7/1985 | Marach | 439/591 |
| 4,531,791 | A | * | 7/1985 | Bauchet | 439/108 |
| 4,542,341 | A | * | 9/1985 | Santomango et al. | 324/750.05 |
| 4,683,454 | A | * | 7/1987 | Vollmer et al. | 335/299 |
| 4,695,920 | A | * | 9/1987 | Klebba et al. | 361/118 |
| 4,869,682 | A | * | 9/1989 | Volk et al. | 439/344 |
| 5,163,854 | A | * | 11/1992 | Licht et al. | 439/630 |
| 5,385,378 | A | * | 1/1995 | Hakamada et al. | 296/37.12 |
| 5,595,505 | A | * | 1/1997 | Duke et al. | 439/630 |
| 5,726,519 | A | * | 3/1998 | Gonnard et al. | 310/323.04 |
| 5,741,161 | A | * | 4/1998 | Cahaly et al. | 439/709 |
| 6,109,952 | A | * | 8/2000 | Jaag | 439/441 |
| 6,146,181 | A | * | 11/2000 | Plaza | 439/357 |
| 7,048,591 | B1 | * | 5/2006 | Chiang | 439/709 |
| 7,084,727 | B2 | * | 8/2006 | Bauer et al. | 335/132 |
| 7,281,958 | B2 | * | 10/2007 | Schuttler et al. | 439/709 |
| 2007/0232097 | A1 | * | 10/2007 | Crippa | 439/108 |
| 2011/0117790 | A1 | * | 5/2011 | Yeh | 439/661 |

FOREIGN PATENT DOCUMENTS

JP 6-338359 * 12/1994

* cited by examiner

*Primary Examiner* — Neil Abrams
(74) *Attorney, Agent, or Firm* — Chun-Ming Shih; HDLS IPR Services

(57) ABSTRACT

A quick-detachable terminal seat includes a main body and a pull rod. The terminal seat is mounted in a casing of a controller which is provided with two notches and locking slots on its periphery. The pull rod has two hooks engaged with the locking slots. The pull rod is provided with two inclined surfaces at locations corresponding to the notches respectively. When the pull rod is pulled out of the main body with the hooks being disengaged from the locking slots, the two inclined surfaces are moved out of the two notches respectively, so that the terminal seat can move upwardly with respect to the casing. In this way, the terminal seat can be detached there from quickly with less labor, or it can be mounted in the casing easily without additional tools. The present invention further provides a programmable logic controller having the terminal seat.

14 Claims, 7 Drawing Sheets

QUICK-DETACHABLE TERMINAL SEAT AND PROGRAMMABLE LOGIC CONTROLLER HAVING THE SAME

BACKGROUND OF THE INVENTION

1. Field of the Invention

The present invention relates to a terminal seat, and in particular to a quick-detachable terminal seat and a programmable logic controller having the same.

2. Description of Prior Art

A terminal seat is a common part in an electronic apparatus. For example, a programmable logic controller (PLC) commonly used in industrial automation is provided with a terminal seat whose surface is arranged with several rows of terminals. A portion of terminals is electrically connected to a circuit board of the PLC, while the other portion of terminals is electrically connected to other electronic elements (such as sensors or controllers) via leads. Finally, the terminal seat is locked to a casing of the PLC. For example, in case of a switchboard on a large-sized electronic apparatus, a plurality of terminal seats is arranged side by side on the switchboard. Since the distance between these terminals is so close that the space available for arranging leads becomes narrow. Even, an operator for arranging the leads may touch the terminals carelessly and thus get an electric shock.

In view of the above, the industry in this art develops a detachable terminal seat, whereby the operator can connect a plurality of leads to the predetermined terminals in advance. Then, the whole detachable terminal seat is electrically connected to the circuit board and fixed to the switchboard. In this way, the problem of narrow space and the risk of getting an electric shock can be avoided.

However, in practice, such a detachable terminal seat still has drawbacks as follows. First, since most of the detachable terminal seats are fixed to the switchboard via screws, the operator needs to use an additional tool (such as a screw driver) to loosen the screws in order to detach the terminal seat from the switchboard. As a result, during the detachment of the terminal seat, the problem of narrow space and the risk of getting an electric shock still exist. Some detachable terminal seats are fixed to the switchboard via fasteners or plastic knobs. Although such an arrangement allows the operator not to use a tool, the operator still needs to hold the terminal seat by one hand, loosen the fastener or plastic knob by the other hand, and then pull the terminal seat out of the switchboard with labor. When a plurality of detachable terminal seats is arranged side by side with the top surfaces of two adjacent terminal seats being in flush with each other, it is difficult for the operator to find a point on the aligned surfaces for exerting a force to pull the terminal seat out of the switchboard.

In prior art, another kind of detachable terminal seat is developed, in which a pull rod is provided. This pull rod functions as an insertion pin for inserting into the terminal seat to thereby fix the rear end of the terminal seat to a casing. However, such a pull rod cannot lift up the terminal seat. Thus, when the operator intends to pull the terminal seat out of the switchboard, the operator has to pull the pull rod out of the terminal seat, and then pull the terminal seat out of the casing. Therefore, the problem of narrow space and difficulty in finding a point for exerting forces still exist.

In the conventional detachable terminal seat, not only its fixation to the casing is defective, but also the operator needs to exert a larger force to detach the terminal seat from the circuit board. On the other hand, the operator has to align the terminal seat with the circuit board, and then press the terminal seat into the casing to complete the assembly. Thus, if a labor-saving mechanism could be provided in the conventional detachable terminal seat, the detachment of the terminal seat may become easier.

Therefore, it is an important issue for the present inventor to solve the above problems.

SUMMARY OF THE INVENTION

The present invention is to provide a quick-detachable terminal seat, which can be easily fixed to a casing of a controller without using an additional tool. Further, such a terminal seat can be detached quickly in a labor-saving manner.

The present invention is to provide a programmable logic controller having a quick-detachable terminal seat, in which the terminal seat can be easily fixed to a casing of the programmable logic controller without using an additional tool. Further, the terminal seat can be quickly detached from the casing of the controller in a labor-saving manner.

The present invention provides a quick-detachable terminal seat, configured to be mounted on a casing of a programmable logic controller, the periphery of the casing being provided with a notch and a locking slot, the terminal seat comprising: a main body having at least one guiding rib on its one side surface; and a pull rod slidingly inserted into the main body, one side surface of the pull rod being formed with a groove for allowing the at least one guiding rib to be inserted therein, a rear end of the pull rod having a first hook engaged with the locking slot, the pull rod having a first inclined surface formed on one side surface opposite to the groove and located corresponding to the notch; wherein the first inclined surface moves upwards with respect to the notch when the pull rod is pulled out of the main body with the first hook being disengaged from the locking slot, the terminal seat can be moved upwards with respect to the casing and detached there from.

The present invention provides a programmable logic controller, which comprises: a casing having a notch and a locking slot on its periphery; and a quick-detachable terminal seat, configured to be mounted on the casing and comprising: a main body having at least one guiding rib on its one side surface; and a pull rod slidingly inserted into the main body, one side surface of the pull rod being formed with a groove for allowing the at least one guiding rib to be inserted therein, a rear end of the pull rod having a first hook engaged with the locking slot, the pull rod having a first inclined surface formed on one side surface opposite to the groove and located corresponding to the notch; wherein the first inclined surface moves upwards with respect to the notch when the pull rod is pulled out of the main body with the first hook being disengaged from the locking slot, the terminal seat can be moved upwards with respect to the casing and detached there from.

In comparison with prior art, the present invention has advantageous features as follows:

According to the present invention, since the pull rod is slidingly inserted into the main body and the first hook of the pull rod is engaged with the locking slot of the casing of the programmable logic controller, the terminal seat can be engaged with the casing quickly. Thus, no locking elements such as screws, fasteners or plastic knobs are needed for fixing the terminal seat to the casing of the programmable logic controller.

According to the present invention, since the user only needs to press the pull rod inwards to generate the engagement between the terminal seat and the casing of the programmable logic controller, or pull outwards the pull rod to release the engagement between the terminal seat and the casing, the operation of the present invention becomes easier. Furthermore, the problem that the user may not find a point in a narrow space or on surfaces of aligned terminals for exerting forces to remove the terminal seat can be avoided.

According to the present invention, since the pull rod is made of plastic materials, the operator may not touch the metallic parts in the terminal seat such as terminals or screws when pulling the pull rod, the risk of getting an electric shock can be avoided.

According to the present invention, since the pull rod is provided with a first inclined surface, and the first inclined surface can be moved upwards by means of the reaction with the notch of the casing, the operator can remove the terminal seat from the casing quickly in a labor-saving manner.

DETAILED DESCRIPTION OF THE INVENTION

Figure 1:
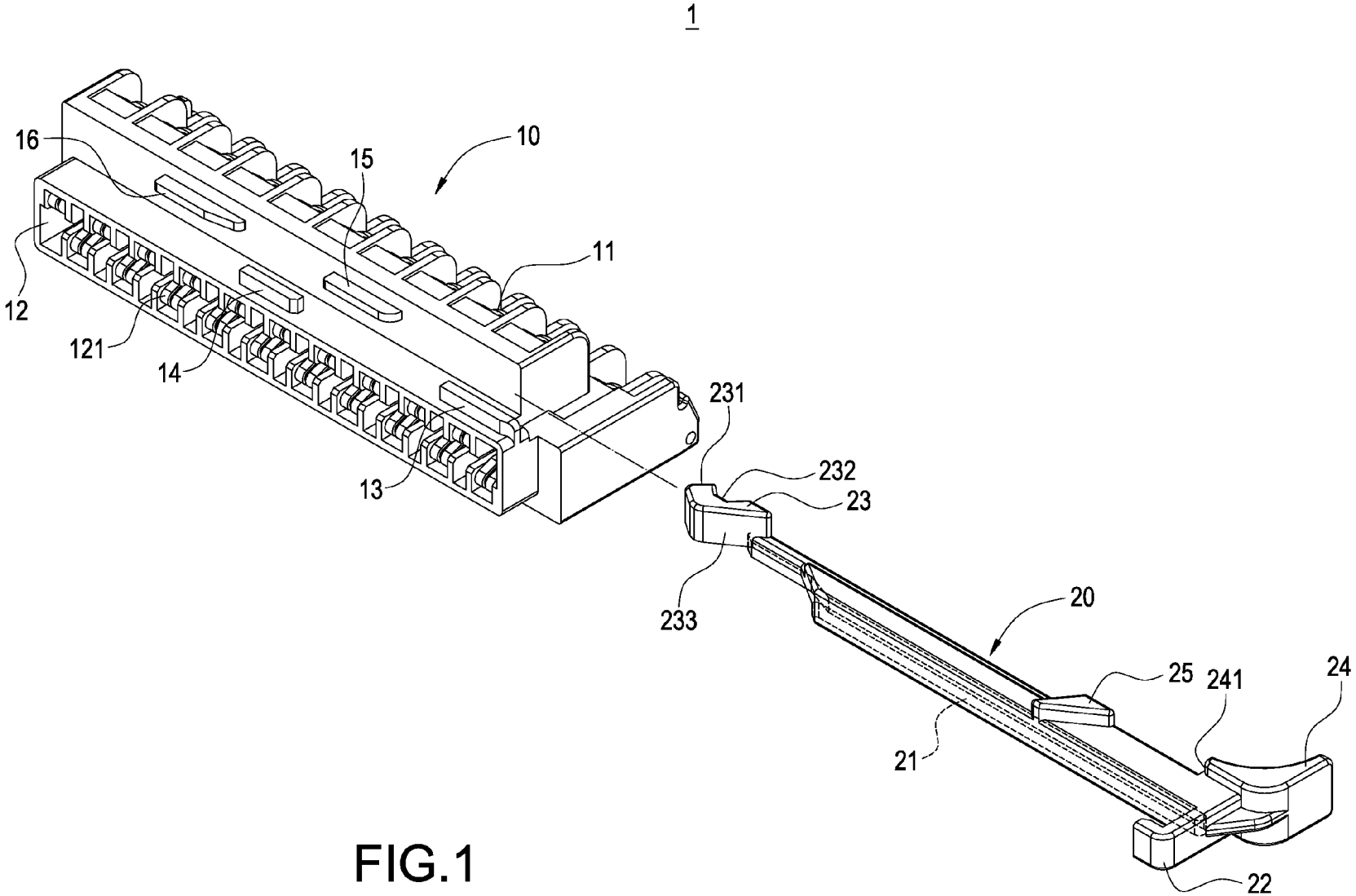
FIG. 1 is an exploded perspective view showing a quick-detachable terminal seat of the present invention.
Figure 2:
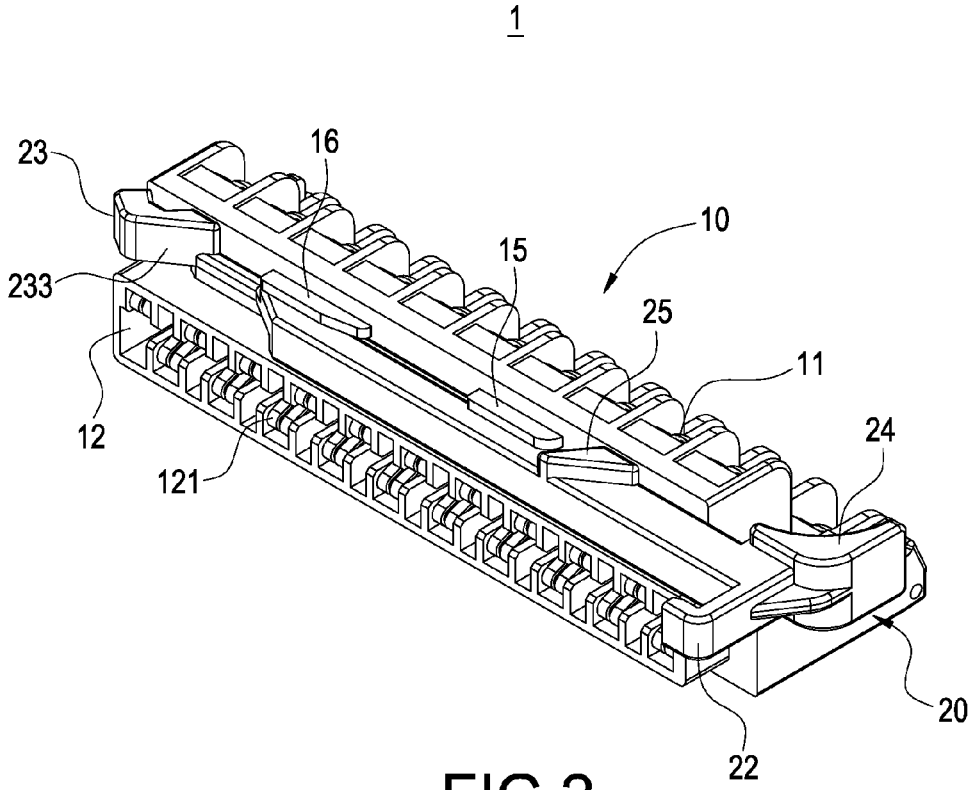
FIG. 2 is an assembled perspective view showing the quick-detachable terminal seat of the present invention.

The detailed description and technical contents of the present invention will be explained with reference to the accompanying drawings. However, it should be understood that the drawings are illustrative only, but not used to limit the present invention.

Please refer to FIGS. 1 to 4. The present invention provides a quick-detachable terminal seat 1 and a programmable logic controller 100 having the terminal seat 1. The terminal seat 1 includes a main body 10 and a pull rod 20. The programmable logic controller 100 includes the terminal seat 1 and a casing 30 shown in FIG. 4.

It should be noted that the directional term "front" refers to a direction along which the pull rod 20 is inserted into the main body 10, while the directional term "rear" refers to the reverse direction of the "front". As a result, the directional terms "top" and "bottom" can be defined accordingly.

As shown in FIG. 1, the main body 10 is substantially formed into a rectangular body and has at least one row of connecting terminals 11 on its top surface. In the present embodiment, two rows of connecting terminals 11 are provided. Since the structure of the connecting terminals 11 is well known, the description relating thereto is omitted. The bottom surface of the main body 10 is provided with a slot 12 in which a circuit board 31 of the casing 30 shown in FIG. 4 can be inserted to achieve an electrical connection there between. The interior of the slot 12 is provided with a plurality of electrical-conductive terminals 121. Each of the electrical-conductive terminals 121 is electrically connected to a connecting terminal 11, thereby achieving the electrical connection between the main body 10 and the casing 30.

One side surface of the main body 10 is formed with at least one guiding rib 13. In the present embodiment, two guiding ribs 13 and 14 are provided at an interval in a line. Two fixing ribs 15 and 16 are provided in parallel to the guiding ribs 13 and 14 respectively. One end of each of the fixing ribs 15 and 16 is formed with a chamfer for smoothing the insertion of the pull rod 20 into the main body 10. It should be noted that, as shown in FIG. 1, the two guiding ribs 13, 14 and the two fixing ribs 15, 16 are positioned in a staggered arrangement.

Figure 3:
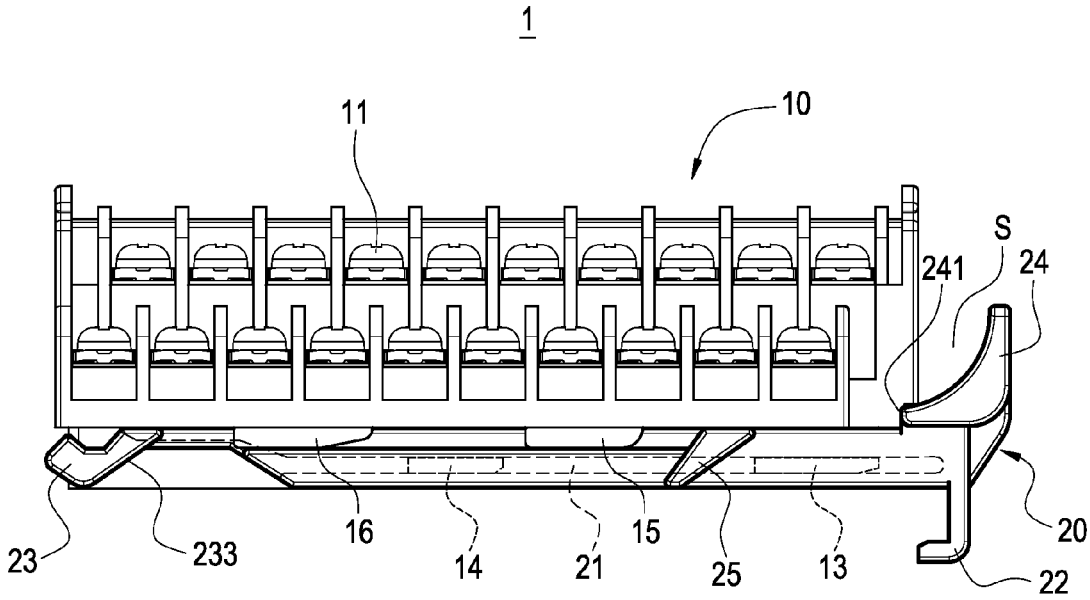
FIG. 3 is an assembled side view showing a quick-detachable terminal seat of the present invention.

The pull rod 20 is a rod made of plastic materials. The pull rod 20 includes a groove 21 formed on one side surface of the pull rod 20 for allowing the guiding ribs 13, 14 to be inserted therein, a first hook 22 formed on the rear end of the pull rod 20, and a second hook 23 formed on the front end of the pull rod 20. When the pull rod 20 is inserted into the main body 10, the pull rod 20 is restricted between the two fixing ribs 15, 16 and the guiding ribs 13, 14, so that the pull rod 20 can only slide forwards or rearwards in the extending direction of the groove 21. Further, the rear end of the pull rod 20 is formed with an operating portion 24. The operating portion 24 is formed on the top of the rear end of the pull rod 20, while the first hook 22 is formed on the bottom of the rear end of the pull rod 20. Taking the ergonomics into consideration, the operating portion 24 is made concave to form an operating space S (as shown in FIG. 3) between the operating portion 24 and the main body 10. The front end of the operating portion 24 is formed with a positioning end 241 for abutting the main body 10. With this arrangement, the operator can put his finger into the operating space S to pull the pull rod 20 out of the main body 10. Thus, the problem in prior art that the operator may not find a point for exerting force can be solved.

The first hook 22 is provided on the bottom of the rear end of the pull rod 20 for fixing the rear end of the main body 10 to the casing 30.

The front side of the second hook 23 is formed with a guiding surface 231. Since the pull rod 20 is made of plastic materials, when the pull rod 20 is inserted into the main body 10, the guiding surface 231 is brought into contact with the chamfers of the fixing ribs 15, 16 successively, so that the second hook 23 suffers an elastic deformation to cross the fixing ribs 15 and 16. In this way, the guiding ribs 13 and 14 can be smoothly inserted into the groove 21 of the pull rod 20, and the pull rod 20 can slide forwards in the direction of the groove 21 with respect to the main body 10. When the second hook 23 moves beyond the fixing rib 16, the second hook 23 is blocked by the fixing rib 16, thereby preventing the accidental disengagement of the pull rod 20 from the main body 10.

The second hook 23 has a recessed portion 232 for fixing the front end of the main body 10 to the casing 30. The rear end and the front end of the main body 10 can be fixed to the casing 30 by means of the first hook 22 and the second hook 23 respectively. Thus, no locking elements such as screws, fasteners or plastic knobs are provided for fixing the terminal seat 1 to the casing 30.

The pull rod 20 is formed with a first inclined surface 25 on one side surface opposite to the groove 21. The rear side of the second hook 22 is formed with a second inclined surface 233. The slope of the first inclined surface 25 is substantially the same as that of the second inclined surface 233. With this arrangement, the first inclined surface 25 is configured to lift up the rear end of the main body 10, and the second inclined surface 233 is configured to lift up the front end of the main body 10. In this way, the operator can remove the main body 10 from the casing 30 in a labor-saving manner, which will be described in more detail later.

Figure 4:
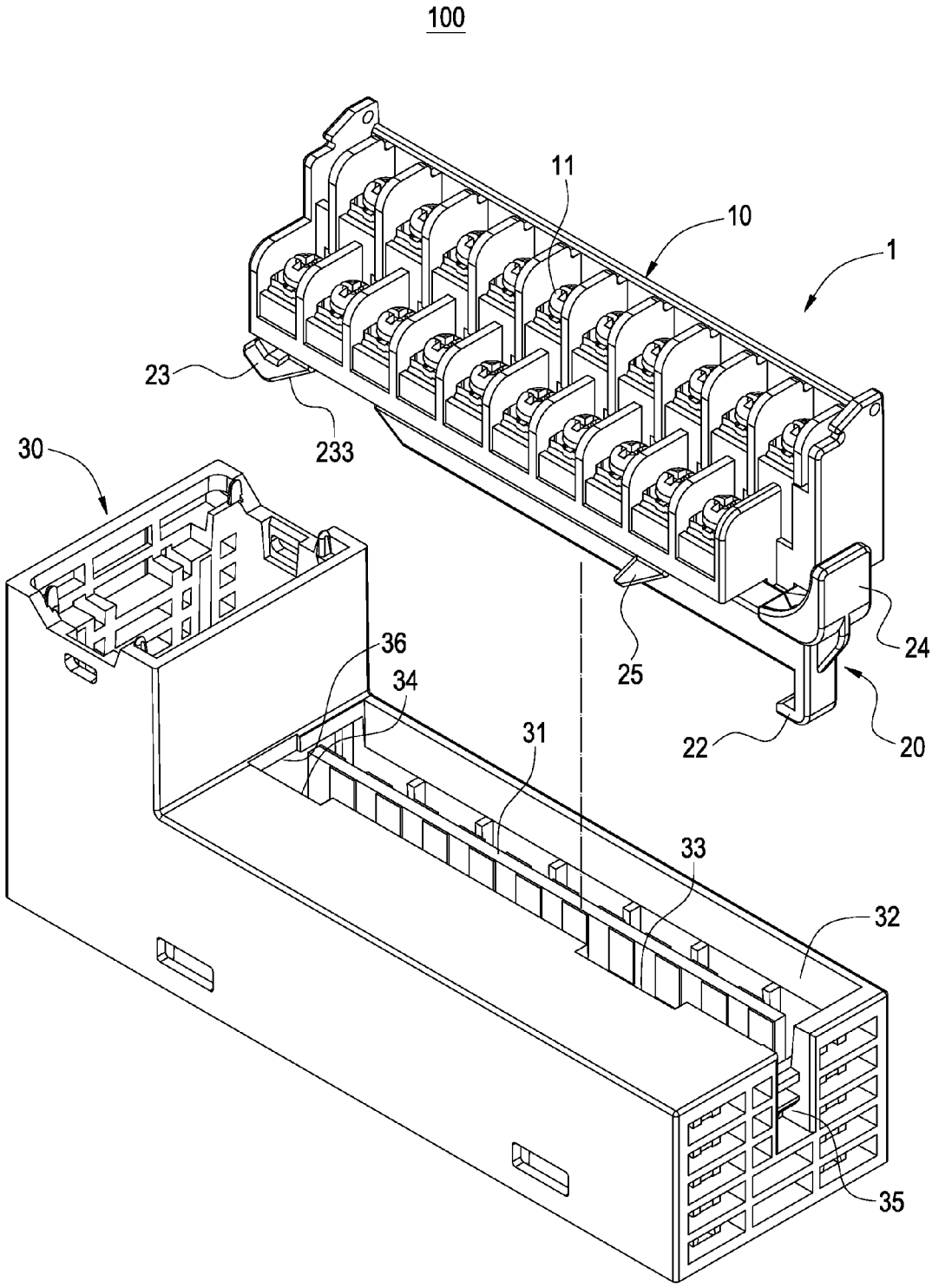
FIG. 4 is an exploded perspective view showing a programmable logic controller of the present invention.

As shown in FIG. 4, the casing 30 of the programmable logic controller 100 has a trough 32 for allowing the main body 10 to be inserted therein, thereby generating an electrical connection between the main body 10 and the circuit board 31 of the casing 30. One side of the trough 32 is provided with two notches 33 and 34. The two notches 33 and 34 are positioned to correspond to the first inclined surface 25 and the second inclined surface 233 respectively. The casing 30 is provided with two locking slots 35 and 36. The first hook 22 is engaged with the locking slot 35, and the second hook 23 is engaged with the locking slot 36. Since the pull rod 20 is assembled with the main body 10, the engagement between the hooks 22, 23 of the pull rod 20 and the casing 30 can cause the main body 10 to be assembled with the casing 30.

Next, the operation of the present invention will be described.

First, the pull rod 20 has to be inserted into the main body 10 according to the steps as follows. The groove 21 of the pull rod 20 is aligned with the guiding rib 13 of the main body 10, and then the pull rod 20 is pressed forwards into the main body 10. At this time, the guiding surface 231 of the second hook 23 of the pull rod 20 is brought into contact with the chamfer of the fixing rib 15 of the main body 10, while the guiding rib 13 is inserted into the groove 21 of the pull rod 20. The guiding surface 231 suffers a downward elastic deformation to cross the fixing rib 15 of the main body 10. Thereafter, the operator presses the pull rod 20 further forwards. At this time, the guiding surface 231 of the pull rod 20 is brought into contact with the chamfer of the fixing rib 16 of the main body 10. In this position, the pull rod 20 is restricted by the two fixing ribs 15 and 16 from any further transverse movement, so that the pull rod 21 can be only moved forwards or rearwards in the extending direction of the groove 21. Then, the second hook 23 of the pull rod 20 is allowed to cross the fixing rib 16. When the second hook 23 crosses the fixing rib 16 without reaching the front edge of the main body 10, the second hook 23 is located in a movable region. The operator has to press the pull rod 20 into the main body 10 until the second hook 23 is located in the movable region. If the pull rod 20 is pushed further forwards with the positioning end 241 of the operating portion 24 abutting the edge of the main body 10, as shown in FIG. 3, the pull rod 20 cannot slide any further.

Next, please refer to FIGS. 5 to 8. The description relating to how the combination of the main body 10 and the pull rod 20 is inserted into the casing 30 and fixed thereto will be made.

Figure 5:
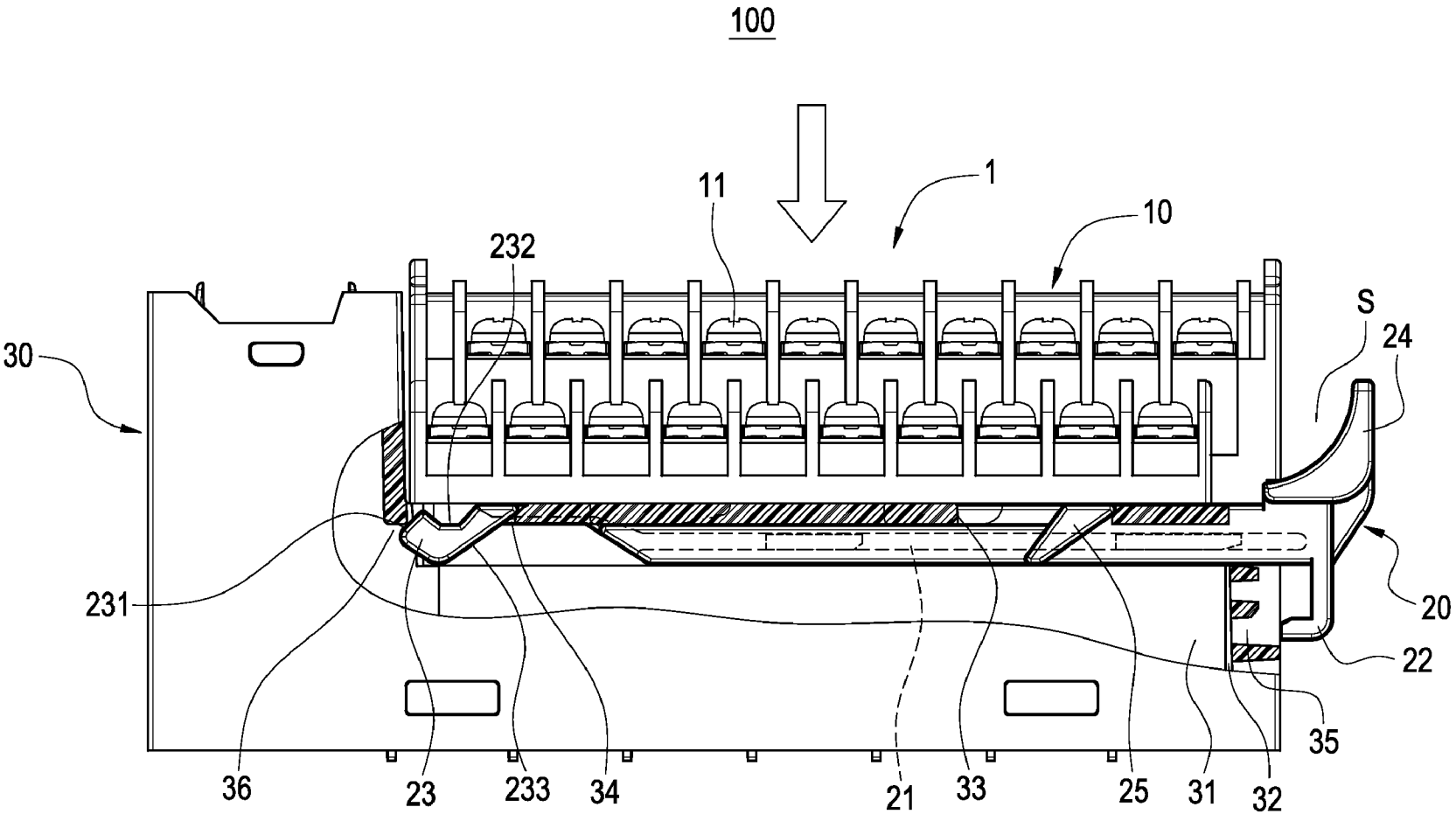
FIG. 5 is a partially side cross-sectional view of the programmable logic controller of the present invention, showing that a pull rod is not inserted into a casing of the controller completely.

As shown in FIG. 5, when the pull rod 20 is inserted into the main body 10 with the second hook 22 being located in the movable region, the operator presses the main body 10 downwards to be inserted into the trough 32 of the casing 30 as shown in the arrow. At this time, the first inclined surface 25 and the second inclined surface 233 of the pull rod 20 are accommodated in the two notches 33 and 34 of the casing 30 respectively.

Figure 6:
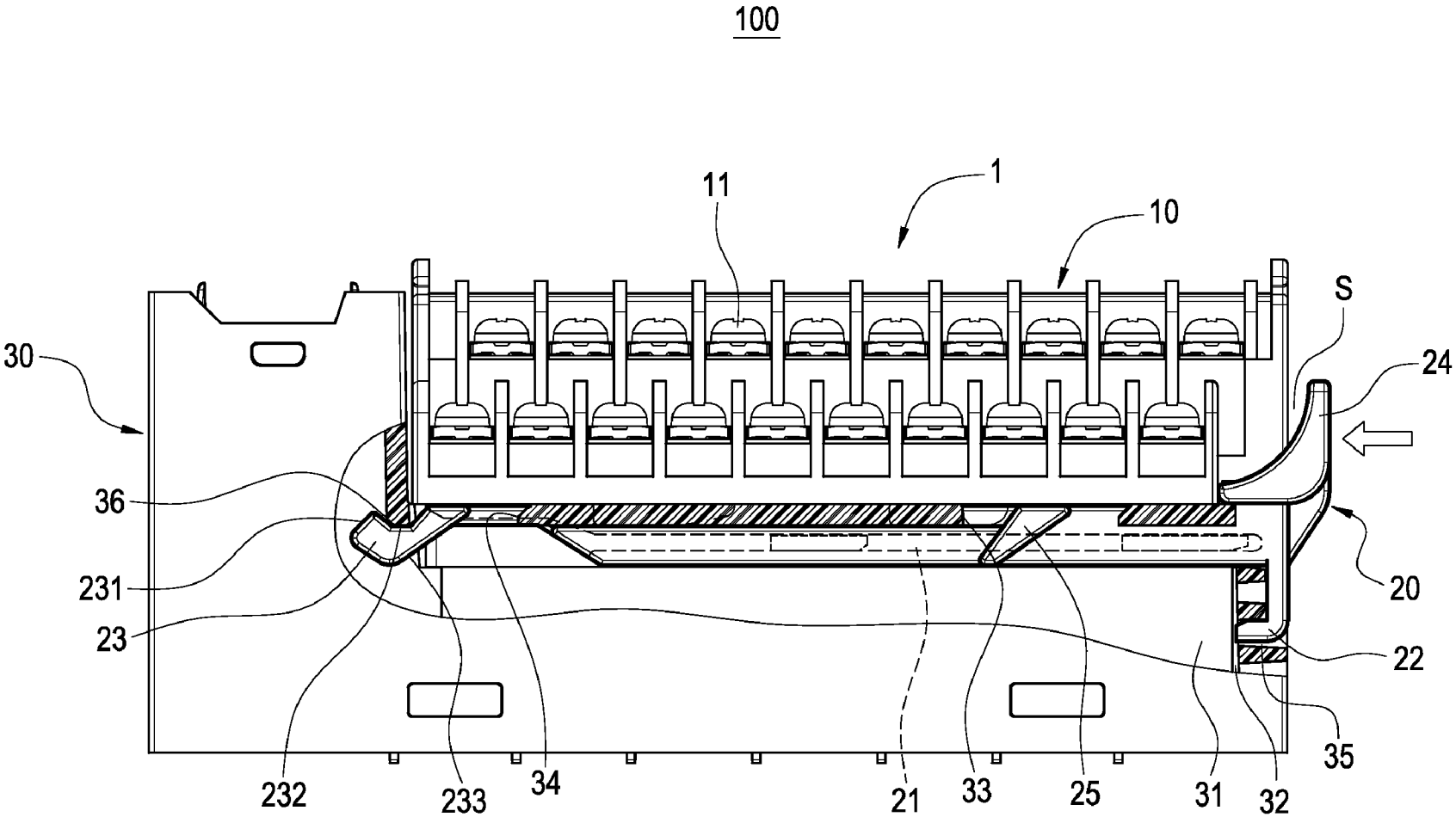
FIG. 6 is a partially side cross-sectional view of the programmable logic controller of the present invention, showing that the pull rod is inserted into the casing of the controller completely.

As shown in FIG. 6, the operator then presses the operating portion 24 of the pull rod 20 inwards. At this time, the guiding surface 231 of the second hook 23 of the pull rod 20 suffers a downward elastic deformation, so that the recessed portion 232 of the second hook 23 is engaged with the locking slot 36 at the front end of the casing 30, while the first hook 22 is engaged with the locking slot 35 at the rear end of the casing 30, thereby fixing the front end and rear end of the main body 10. I this way, the main body 10 cannot be detached from the casing 30 easily.

Figure 7:
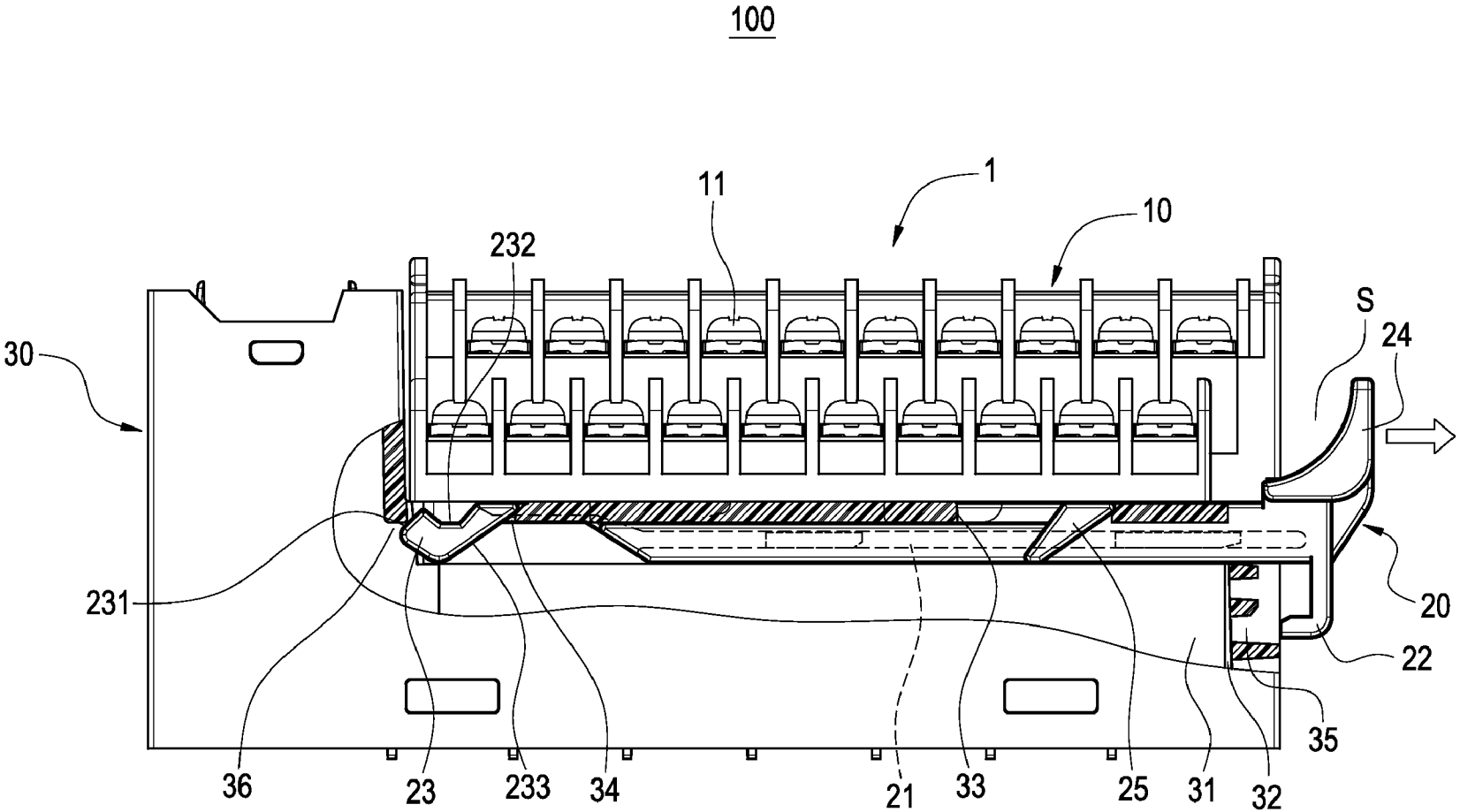
FIG. 7 is a partially side cross-sectional view of the programmable logic controller of the present invention, showing that the pull rod is to be removed from the casing of the controller.

As shown in FIG. 7, when the operator intends to detach the main body 10 from the casing 30, the operator can put his finger into the operating space S of the operating portion 24 to pull the pull rod 20 rearwards. In this way, the first hook 22 and the second hook 23 are disengaged from the locking slots 35 and 36 respectively. At this time, the first inclined surface 25 and the second inclined surface 233 abut the notches 33 and 34 of the casing 30 respectively.

Figure 8:
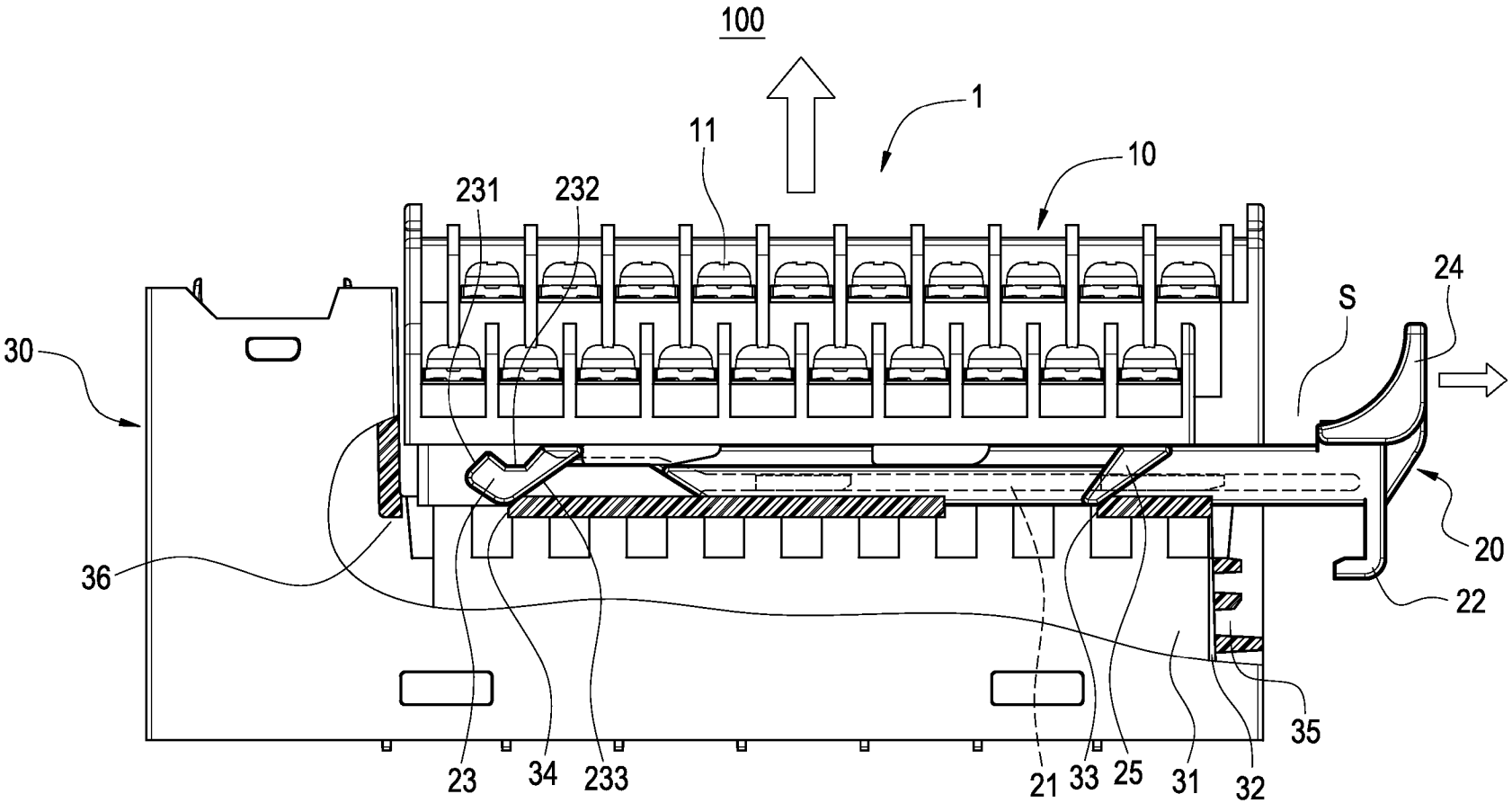
FIG. 8 is a partially side cross-sectional view of the programmable logic controller of the present invention, showing that the pull rod has been removed from the casing of the controller to lift up the terminal seat.

As shown in FIG. 8, when the operator pulls the operating portion 24 of the pull rod 20 further rearwards, the first inclined surface 25 and the second inclined surface 233 are moved upwards with respect to the notches 33 and 34 respectively, so that the main body 10 and the pull rod 20 can move upwards a small distance with respect to the casing 30. In this way, the slot 12 of the main body 10 can be separated from the circuit board 31 of the casing 30, thereby detaching the terminal seat 1 from the casing 30.

In comparison with prior art, the present invention has advantageous features as follows:

According to the present invention, since the pull rod 20 is slidingly inserted into the main body 10 and the first hook 22 and the second hook 23 of the pull rod 20 are engaged with the locking slots 35 and 36 of the casing 30 respectively, the terminal seat 1 can be engaged with the casing 30 quickly. Thus, no locking elements such as screws, fasteners or plastic knobs are needed for fixing the terminal seat 1 to the casing 30 of the programmable logic controller 100.

According to the present invention, since the user only needs to press the pull rod 20 inwards to generate the engagement between the terminal seat 1 and the casing 30, or pull outwards the pull rod 20 to release the engagement between the terminal seat 1 and the casing 30, the operation of the present invention becomes easier, and the user needs not to use an addition tool. Furthermore, the problem that the user may not find a point in a narrow space or on the surfaces of aligned terminals for exerting force to remove the terminal seat 1 can be avoided.

According to the present invention, since the pull rod 20 is made of plastic materials, the operator may not touch the metallic parts in the terminal seat 1 such as terminals or screws when pulling the pull rod 20, the risk of getting an electric shock can be avoided.

According to the present invention, since the pull rod 20 is provided with a first inclined surface 25 and a second inclined surface 233, the first inclined surface 25 and the second inclined surface 233 can be moved upwards by means of the reaction with the notches 33 and 34 of the casing 30, so that the operator can remove the terminal seat 1 from the casing 30 quickly in a labor-saving manner.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A quick-detachable terminal seat, configured to be mounted on a casing of a programmable logic controller, the periphery of the casing being provided with a notch and a locking slot, the terminal seat comprising:

a main body having at least one guiding rib on one side surface thereof; and a pull rod slidably inserted into the main body, one side surface of the pull rod being formed with a groove for allowing the at least one guiding rib to be inserted therein, a rear end of the pull rod having a first hook engaged with the locking slot, the pull rod having a first inclined surface formed on one side surface opposite to the groove and located corresponding to the notch;

wherein the first inclined surface moves upwards with respect to the notch when the pull rod is pulled out of the main body with the first hook being disengaged from the locking slot, the terminal seat can be moved upwards with respect to the casing and detached therefrom.

2. The quick-detachable terminal seat according to claim 1, wherein a front end of the pull rod is formed with a second hook, the periphery of the casing is further provided with a locking slot for allowing the second hook to be engaged therewith.

3. The quick-detachable terminal seat according to claim 2, wherein a rear surface of the second hook is formed with a second inclined surface, the second inclined surface is located on the same side as the first inclined surface with a consistent slope, the periphery of the casing is provided with another notch at a position corresponding to the second inclined surface.

4. The quick-detachable terminal seat according to claim 3, wherein the side surface of the main body is further formed with two fixing ribs in parallel to the at least one guiding rib, the pull rod is restricted between the two fixing ribs and the at least one guiding rib in such a manner that the pull rod can only slide forwards or rearwards in the extending direction of the groove.

5. The quick-detachable terminal seat according to claim 4, wherein the rear end of the pull rod is further provided with an operating portion, a front end of the operating portion is formed with a positioning end for abutting the main body, an operating space is formed between the operating portion and the main body.

6. The quick-detachable terminal seat according to claim 5, wherein the operating portion is formed on the top of the rear end of the pull rod, and the first hook is formed on the bottom of the rear end of the pull rod.

7. The quick-detachable terminal seat according to claim 6, wherein a circuit board is mounted in the casing, the bottom surface of the main body is provided with a slot for allowing the circuit board to be inserted therein, the interior of the slot is arranged with a plurality of electrical-conductive terminals for electrically connecting the circuit board.

8. A programmable logic controller, comprising:

a casing having a notch and a locking slot on the periphery thereof; and a quick-detachable terminal seat, configured to be mounted on the casing and comprising:

a main body having at least one guiding rib on one side surface thereof; and a pull rod slidably inserted into the main body, one side surface of the pull rod being formed with a groove for allowing the at least one guiding rib to be inserted therein, a rear end of the pull rod having a first hook engaged with the locking slot, the pull rod having a first inclined surface formed on one side surface opposite to the groove and located corresponding to the notch;

wherein the first inclined surface moves upwards with respect to the notch when the pull rod is pulled out of the main body with the first hook being disengaged from the locking slot, the terminal seat can be moved upwards with respect to the casing and detached there from.

9. The programmable logic controller according to claim 8, wherein a front end of the pull rod is formed with a second hook, the periphery of the casing is further provided with a locking slot for allowing the second hook to be engaged therewith.

10. The programmable logic controller according to claim 9, wherein a rear surface of the second hook is formed with a second inclined surface, the second inclined surface is located on the same side as the first inclined surface with a consistent slope, the periphery of the casing is provided with another notch at a position corresponding to the second inclined surface.

11. The programmable logic controller according to claim 10, wherein the side surface of the main body is further formed with two fixing ribs in parallel to the at least one guiding rib, the pull rod is restricted between the two fixing ribs and the at least one guiding rib in such a manner that the pull rod can only slide forwards or rearwards in the extending direction of the groove.

12. The programmable logic controller according to claim 11, wherein the rear end of the pull rod is further provided with an operating portion, a front end of the operating portion is formed with a positioning end for abutting the main body, an operating space is formed between the operating portion and the main body.

13. The programmable logic controller according to claim 12, wherein the operating portion is formed on the top of the rear end of the pull rod, and the first hook is formed on the bottom of the rear end of the pull rod.

14. The programmable logic controller according to claim 13, wherein a circuit board is mounted in the casing, the bottom surface of the main body is provided with a slot for allowing the circuit board to be inserted therein, the interior of the slot is arranged with a plurality of electrical-conductive terminals for electrically connecting the circuit board.

* * * * *